US010532240B2

(12) United States Patent
Thrasher-Rudd

(10) Patent No.: US 10,532,240 B2
(45) **Date of Patent: *Jan. 14, 2020**

(54) RESISTANCE TRAINING DEVICE AND METHOD

(71) Applicant: Christine Thrasher-Rudd, Indianapolis, IN (US)

(72) Inventor: Christine Thrasher-Rudd, Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/250,163

(22) Filed: Aug. 29, 2016

(65) Prior Publication Data

US 2017/0225024 A1 Aug. 10, 2017

Related U.S. Application Data

(63) Continuation-in-part of application No. 13/337,383, filed on Dec. 27, 2011, now Pat. No. 9,427,622.

(51) Int. Cl.
*A63B 21/055* (2006.01)
*A63B 21/04* (2006.01)
*A63B 21/00* (2006.01)

(52) U.S. Cl.
CPC ..... *A63B 21/0552* (2013.01); *A63B 21/0442* (2013.01); *A63B 21/4035* (2015.10)

(58) Field of Classification Search
CPC ..... A63B 21/0407; A63B 21/0414; A63B 21/0421; A63B 21/0428; A63B 21/0435; A63B 21/0442; A63B 21/05; A63B 21/055; A63B 21/0552; A63B 21/0555; A63B 21/0557; A63B 21/16; A63B 21/169; A63B 21/1645; A63B 21/04–0557
See application file for complete search history.

(56) References Cited

U.S. PATENT DOCUMENTS 418,257 A * 12/1889 Whitely ..... A63B 21/0552 482/129
562,389 A * 6/1896 Gossweiler ..... A63B 21/0552 482/129
1,965,511 A * 7/1934 Preston ..... A63B 21/04 16/445
6,319,179 B1 * 11/2001 Hinds ..... A63B 21/0552 482/121
6,322,483 B1 * 11/2001 Rotella ..... A63B 21/0552 482/121
8,979,716 B1 * 3/2015 Rawlins ..... A63B 21/0442 482/129

(Continued)

OTHER PUBLICATIONS https://blackmountainproducts.com/exercises/ Published Jul. 13, 2013 Resistance Band Exercise pp. 1-3 and Lower Body Exercise.*

(Continued)

*Primary Examiner* — Nyca T Nguyen
(74) *Attorney, Agent, or Firm* — Ice Miller LLP

(57) ABSTRACT

A method for use with a physical training device is provided. The device including an elastic resistance strap having first and second handles. The method includes pulling at least one of the first and second handles to generate force on a target muscle group through resistance training. The method also includes pulling the at least one of the first and second handles to generate anaerobic and aerobic muscle activity within the target muscle group through cardiovascular interval training.

13 Claims, 28 Drawing Sheets

(56) References Cited

U.S. PATENT DOCUMENTS

| | | | | |
|---|---|---|---|---|
| 2011/0237410 | A1* | 9/2011 | Perez | A63B 21/0557<br>482/129 |
| 2012/0277074 | A1* | 11/2012 | Zeldakov | A63B 21/154<br>482/126 |
| 2013/0143724 | A1* | 6/2013 | DeMeo | A63B 21/00185<br>482/131 |

OTHER PUBLICATIONS

Google search with https://blackmountainproducts.com/exercises/ Published Jul. 13, 2013.*

* cited by examiner

RESISTANCE TRAINING DEVICE AND METHOD

CROSS-REFERENCE TO RELATED APPLICATIONS

The present disclosure is a continuation in part of, and claims priority to, U.S. patent application Ser. No. 13/337,383, filed Dec. 27, 2011 and having the title "RESISTANCE TRAINING DEVICE AND METHOD", which is herein incorporated in its entirety by reference.

FIELD OF THE DISCLOSURE

The present disclosure relates to a physical training device and method. More particularly, the present disclosure relates to a resistance-based physical training device and method.

BACKGROUND OF THE DISCLOSURE

Some exercises are performed without the use of supplemental equipment. For example, a person may perform sit-ups or crunches to strengthen his or her abdominal muscles without the use of supplemental equipment. However, sit-ups and crunches may only work a limited region of the abdominal muscles. As another example, a person may walk, jog, or run without the use of specialized equipment.

Other exercises may be performed with supplemental equipment. The supplemental equipment may be designed to enhance the workout and/or to make the workout more comfortable. One such piece of supplemental equipment is the TRX® suspension training device available from Fitness Anywhere, LLC of San Francisco, Calif. The TRX® device is inelastic and requires the user to suspend his or her body weight, such as by as leaning or hanging from the device. However, these movements may put unwanted pressure on the user's joints and make the user unstable.

Generally, many exercises focus on one of resistance training or cardiovascular training. Resistance training is the collective term for various types of strength building exercises that cause the muscles to contract against an external resistance with the expectation of increases in strength, tone, mass, and/or endurance, which promote muscle growth. This approach makes use of different types of hydraulic or elastic action that involves resistance to being stretched, pulled, squeezed, or bent. Resistance training recruits agonist and antagonist muscles. Resistance training may be isotonic in design. This means that some part of the body is moving against some type of force, such as when attempting to stretch an exercise band. Training of this type may also involve exercises that are considered isometric, meaning that the body part is being subjected to a force while remaining still.

Resistance training works by breaking down the muscle cells, which in turn are quickly repaired by the body to help the muscles regenerate and grow stronger. The breakdown of the muscle fiber is called "catabolism", and the repair and re-growth of the muscle tissue is called "anabolism". Anabolic happens after you break down the muscle fibers with resistance exercise. Many biological processes of growth in the body require some breakdown, or catabolism, prior to re-growth. The concept behind resistance training is to continually manipulate and change the amount of force, the number of repetitions, and exercises used in order to achieve changes in your muscles. Lower resistance with higher repetitions will increase muscle endurance while higher resistance with less repetitions increases strength and muscle mass, the latter being the foundation of any muscle gaining program.

Multiple research studies demonstrate that resistance training has a positive relationship to health factors and fighting chronic disease and therefore should be an integral part of an exercise and weight management routine. Resistance training has been shown to be beneficial in the prevention and management of chronic conditions such as: low back pain; osteoporosis; loss of skeletal muscle mass that may accompany aging; diabetes; susceptibility to falls; impaired physical function in frail and elderly persons; and prevention of and rehabilitation from orthopedic injuries.

Cardio (cardiovascular) interval training, also known as high-intensity interval training (HIIT), is intense cardio exercise intended to burn fat and build lean muscle. In normal cardio exercise, an individual engages in some form of generally low-intensity exercise, such as jogging or biking, for an extended period of time with few, if any, breaks. Cardio interval training involved a different approach: short, high-intensity cardio exercises punctuated by short break.

Interval training includes anaerobic and aerobic activity, causing your heart and lungs to work harder, and giving you a results-oriented workout. Anaerobic refers to the high intensity point in your exercise, or when you are lacking oxygen. This is when stored glucose and fat are burned while your heart is working at 85 percent peak capacity. At this intensity level, your muscles are being forced to not rely on oxygen to fuel muscle contraction, and during this period, lactic acid is formed. Lactic acid causes your muscles to break down and fatigue, making your exercise intensity to eventually decrease. You know lactic acid is forming when the burning sensation takes over your muscles.

Aerobic refers to the recovery point in your cardio session, and it is when your body refuses on oxygen. This is the point in your exercise where your heart and lungs have to work extra hard to pay back that oxygen deficiency, and break down the lactic acid that was accumulated. During the aerobic state go your workout, you are building stamina. By having a recovery period throughout the workout, your body is able to exercise longer, leading to a gradual cardio improvement.

One of the main benefits of cardio interval training comes from a phenomenon called excess post exercise oxygen consumption, or EPOC. After exercise, the body continues to burn calories in an attempt to completely return to a healthy post-exercise resting equilibrium. Hormones must be returned to proper balance, cells must be repaired, energy stores must be replenished, and metabolism must be returned to a normal resting level. This process does occur after normal cardiovascular or aerobic exercises, but the effects are much stronger and longer-lasting after short, intense exercises. Essentially, this means that, for up to a day and a half after engaging varied, high-intensity workouts, the body will continue to burn calories at a slightly increased rate.

Improvements found from cardio training may include: weight loss; stronger heart and lung; increased bone density; reduced stress; reduced risk of heart disease and some types of cancer; better sleep; and increased energy.

SUMMARY

In one aspect, a method for use with a physical training device is provided. The device includes an elastic resistance strap having at least one handle. The method includes coupling the elastic resistance strap to an overhead support so that an end of the elastic strap hangs freely from the support. The method also includes pulling the at least one handle of the elastic resistance strap to alternate between resistance training and cardiovascular interval training.

In one aspect, the at least one handle includes a first handle and a second handle. The device has an obstruction-free radius of at least about 20 inches between the first handles and the second handle.

In one aspect, the method also includes pulling the first handle and the second handle with the same hand.

In one aspect, the device includes an inelastic support strap coupled to the support. The method also includes coupling the elastic resistance strap to one of a plurality of loops in the inelastic support strap.

In one aspect, the at least one handle includes a first handle and a second handle. The method also includes positioning the first handle and the second handle of the elastic resistance strap at or above shoulder height when the elastic resistance strap is at rest.

In one aspect, a method for use with a physical training device is provided. The device includes an elastic resistance strap having at least one handle. The method includes coupling the elastic resistance strap to a support. The method also includes pulling the at least one handle of the elastic resistance strap to alternate between resistance training and cardiovascular interval training.

In one aspect, the at least one handle includes a first handle and a second handle. The device has an obstruction-free radius of at least about 20 inches between the first handle and the second handle.

In one aspect, the method also includes pulling the first handle and the second handle with the same hand.

In one aspect, the device includes an inelastic support strap coupled to the support. The method also includes coupling the elastic resistance strap to one of a plurality of loops in the inelastic support strap.

In one aspect, the at least one handle includes a first handle and a second handle. The also includes positioning the first handle and the second handle of the elastic resistance strap at or above shoulder height when the elastic resistance strap is at rest.

In one aspect, a method for use with a physical training device is provided. The device including an elastic resistance strap having first and second handles. The method includes pulling at least one of the first and second handles to generate force on a target muscle group through resistance training. The method also includes pulling the at least one of the first and second handles to generate anaerobic and aerobic muscle activity within the target muscle group through cardiovascular interval training.

In one aspect, the method also includes alternating between resistance training and cardiovascular interval training.

In one aspect, the method also includes alternating between resistance training and cardiovascular interval training with a physical training device secured overhead.

In one aspect, the method also includes alternating between resistance training and cardiovascular interval training with a physical training device secured to a wall.

In one aspect, the method also includes pulling the first and second handles with the same hand.

In one aspect, the method also includes pulling the first handle with a first hand.

The method also includes pulling the second handle with a second hand.

In one aspect, the method also includes alternating pulling the first handle with the first hand, and pulling the second handle with the second hand.

In one aspect, the method also includes using a physical training device secured to an overhead support.

In one aspect, the method also includes using a physical training device secured to a wall support.

In one aspect, the method also includes using a physical training device secured to the floor by a foot.

BRIEF DESCRIPTION OF THE DRAWINGS

The above mentioned embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

Corresponding reference characters indicate corresponding parts throughout the several views. The exemplifications set out herein illustrate exemplary embodiments and such exemplifications are not to be construed as limiting the scope of the disclosed embodiments in any manner.

DETAILED DESCRIPTION

Figure 1:
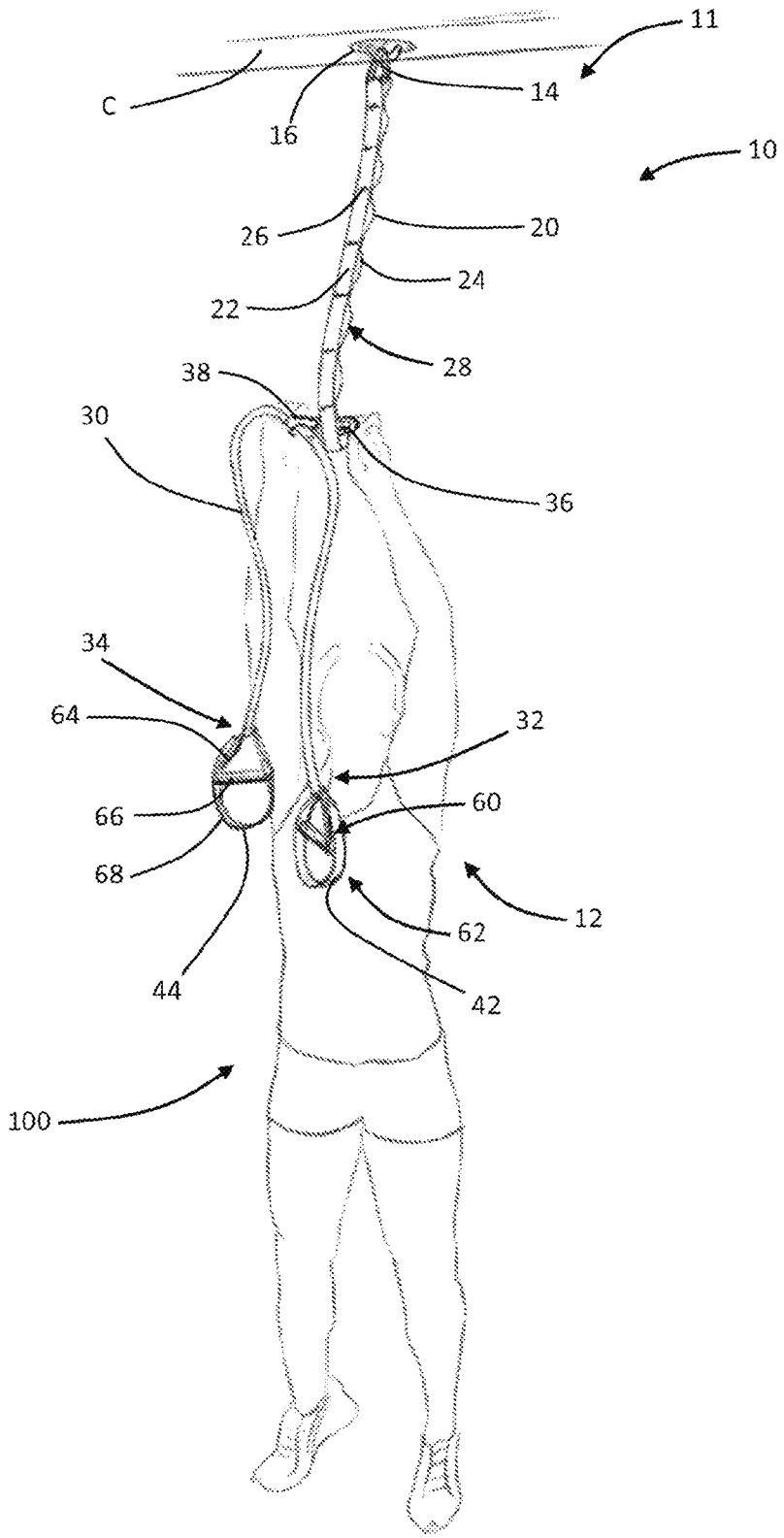
FIG. 1 is a front perspective view of an exemplary physical training device shown hanging from a ceiling, the device including a support strap and a resistance strap with handles.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

A physical training device 10 is provided that hangs vertically downward from a horizontal support toward a user 100. Device 10 includes a first or top end 11 located near the horizontal support and a second or bottom end 12 located near user 100.

Figure 2:
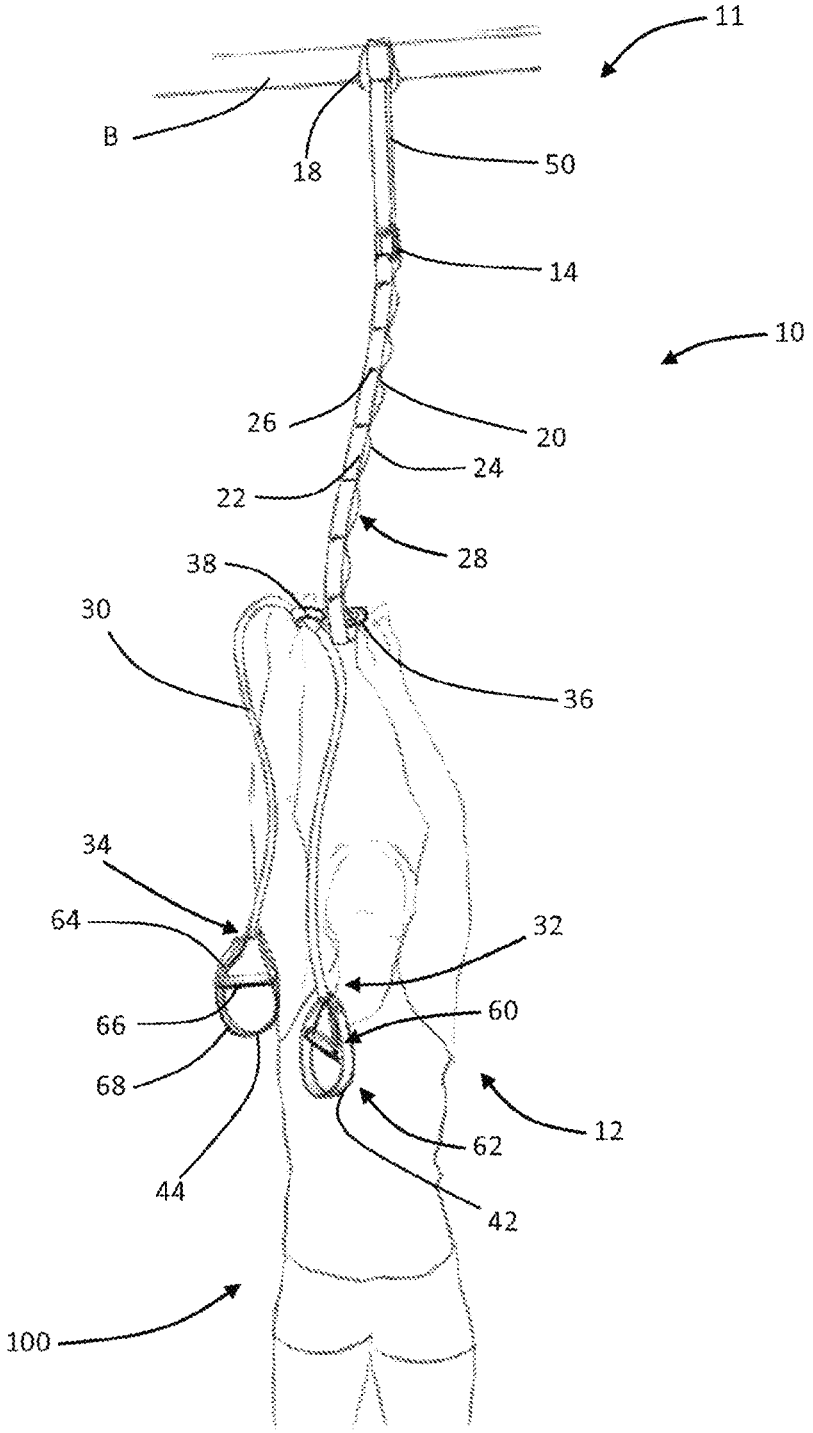
FIG. 2 is a front perspective view of the device of FIG. 1 shown hanging from a beam, the device further including an extension strap above the support strap.

Top end 11 of device 10 is coupled to the horizontal support at a location above user 100. In one embodiment, the horizontal support is a ceiling C or another overhead surface, as shown in FIG. 1. In this embodiment of FIG. 1, device 10 includes hook 14, illustratively a carabiner that hooks securely but removably into mount 16 on ceiling C. In another embodiment, the horizontal support is a beam B or another overhead structure, as shown in FIG. 2. In this embodiment of FIG. 2, device includes loop 18 that wraps around beam B. For flexibility of usage, device 10 may include both hook 14 and the removable loop 18, as shown in FIG. 2.

According to an exemplary embodiment of the present disclosure, user 100 has full freedom of movement beneath the horizontal support (e.g., beam B, ceiling C). Rather than having to mount device 10 into a door frame or onto a door knob, for example, where the vertical door jamb and the door may obstruct movement, device 10 may be mounted to a horizontal support (e.g., beam B, ceiling C) that lacks underlying obstructions. Specifically, device 10 may lack obstructions within a cylindrical region that spans vertically from the horizontal support to the ground, the device 10 defining the longitudinal axis of the cylindrical region, and the cylindrical region having an obstruction-free radius of at least 20 inches, 30 inches, 40 inches, 50 inches, or more, from the longitudinal axis. If device 10 were to be hung in a standard door frame, the obstruction-free radius around device 10 may be less than 20 inches, such as about 12 inches or 18 inches, for example.

Top end 11 of device 10 includes a first, flexible, inelastic support strap 20 coupled to hook 14. Support strap 20 is shown further in FIGS. 3A-3C. Support strap 20 may be constructed of two adjacent strips 22, 24, of flexible, inelastic material, such as nylon webbing. The inelastic material of support strap 20 should maintain a substantially fixed length when pulled by user 100. An exemplary support strap 20 is about 25 inches to about 35 inches in length LS, and more specifically about 30 inches in length LS, for example. However, the length LS of support strap 20 may vary depending on the height of the horizontal support (e.g., beam B, ceiling C) above user 100. An exemplary support strap 20 is about 1 inch to about 3 inches in width WS, and more specifically about 1.5 inches in width WS.

Figure 3A:
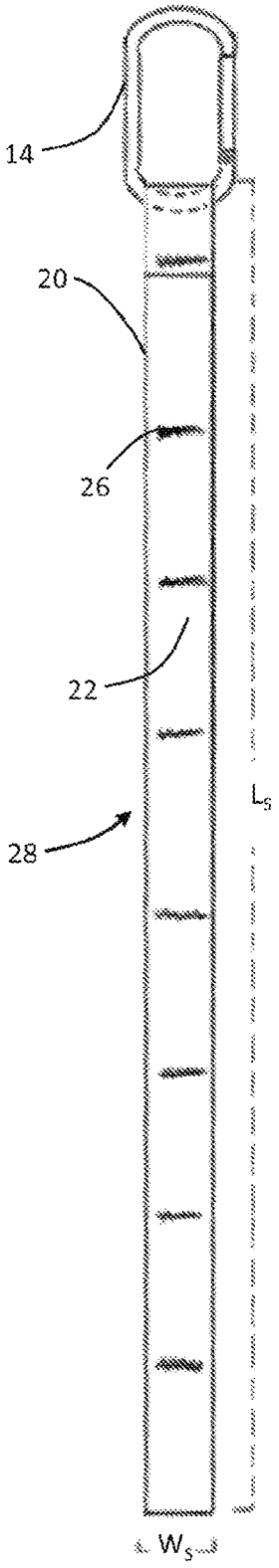
FIG. 3A is a front or rear elevational view of the support strap of FIG. 1.
Figure 3B:
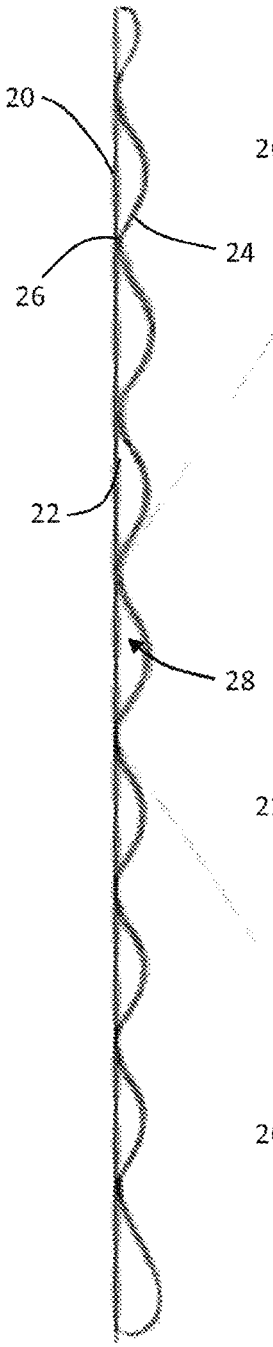
FIG. 3B is a side elevational view of the support strap of FIG. 3A.
Figure 4:
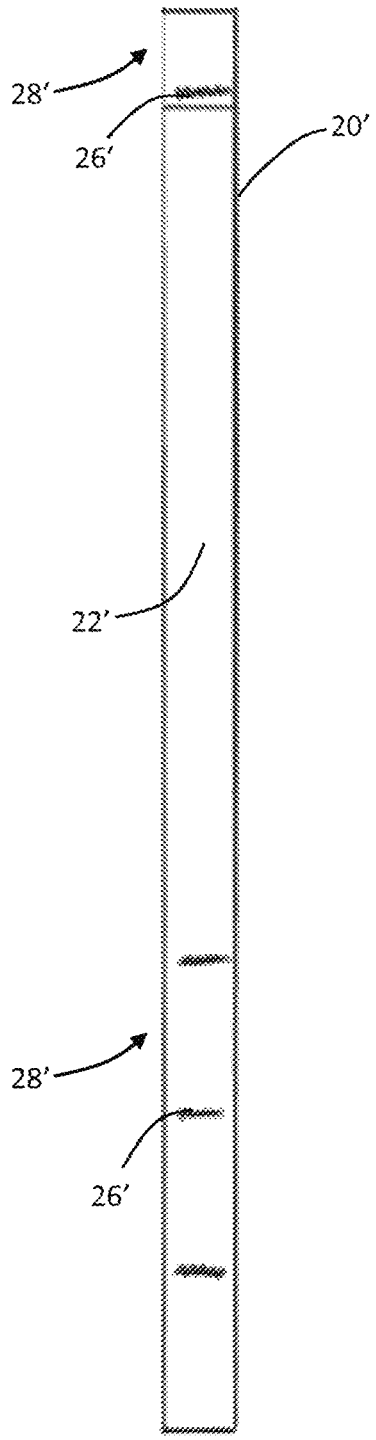
FIG. 4 is a front or rear elevational view of another support strap.

Strips 22, 24, of support strap 20 are sewn together at spaced-apart seams 26 to define a plurality of vertically-spaced loops 28 therebetween, as shown in FIGS. 3A and 3B. The illustrated support strap 20 includes nine vertically-spaced loops 28, although the number of loops 28 may vary. Also, the illustrated support strap 20 includes loops 28 spaced substantially evenly from end to end, although the location of and spacing between each loop 28 may vary. For example, in FIG. 4, another support strap 20' is shown with four loops 28', including one loop 28' at the top end of support strap 20', three loops 28' at the bottom end of support strap 20', and no loops in the middle of support strap 20'.

Figure 3C:
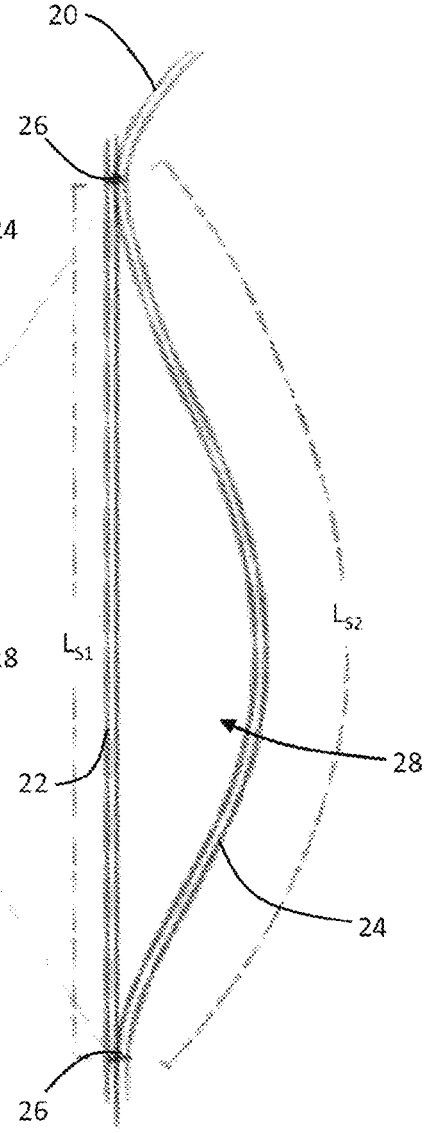
FIG. 3C is a partial side elevational view of the support strap of FIG. 3B.

Between adjacent seams 26, one strip of support strap 20 (e.g., strip 24) may be longer than the other strip of support strap 20 (e.g., strip 22), such that the longer strip 24 is forced outward, as shown in FIG. 3C. If the shorter strip 22 is about 3 inches in length LS1, for example, the longer strip 24 may be about 3.5 inches in length LS2, or more, making the longer strip 24 more than about 15% longer than the shorter strip 22. In use, the longer strip 24 is forced outward to make the corresponding loop 28 larger and more easily accessible.

Figures 5A, 5B, 5C:
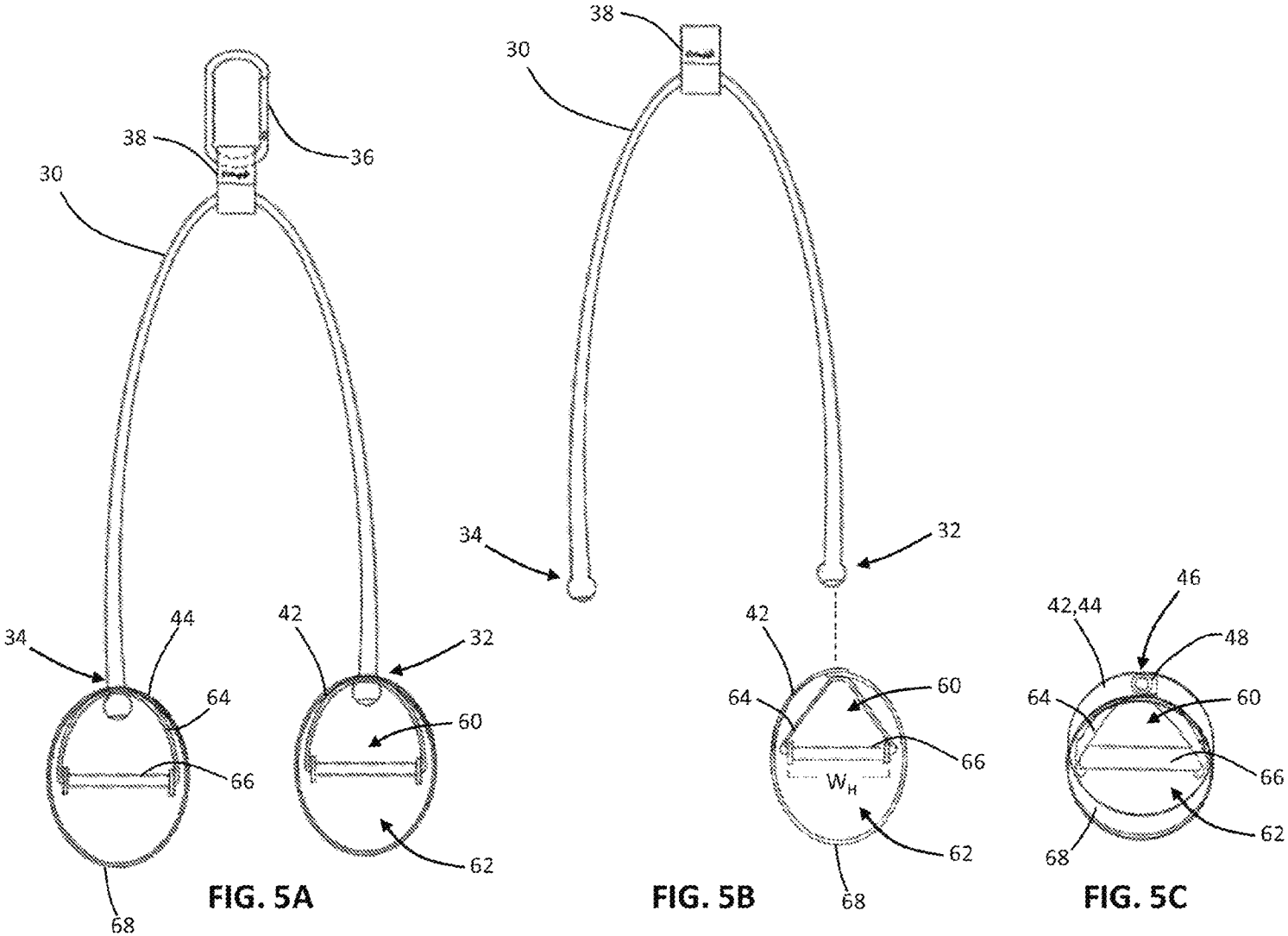
FIG. 5A is an assembled, front elevational view of the resistance strap and the handles of FIG. 1.
FIG. 5B is an exploded, front elevational view of the resistance strap and one of the handles of FIG. 5A.
FIG. 5C is a top perspective view of the handle of FIG. 5B.

Bottom end 12 of device 10 includes a second, flexible, elastic resistance strap 30 removably coupled to support strap 20. Resistance strap 30 is shown further in FIGS. 5A-5B and extends from left end 32 to right end 34. Resistance strap 30 may be constructed of rubber or another suitable elastomeric material that stretches by a noticeable amount (e.g., 1 inch, 3 inches, 5 inches, or more) when pulled by user 100 and returns to its original, natural state when released. Resistance strap 30 may be in the shape of round exercise tubing, as shown, or a flat band, for example. When at rest, an exemplary resistance strap 30 is about 40 inches to about 60 inches in total length, and more specifically about 50 inches in total length, for example. Thus, when resistance strap 30 is at rest and supported halfway between left end 32 and right end 34, as shown in FIG. 5A, resistance strap 30 may extend vertically downward from support strap 20 by about 25 inches to each end 32, 34. If support strap 20 is about 30 inches in length LS (FIG. 3A), for example, and each half or side of resistance strap 30 is about 25 inches in length (FIG. 5A), support strap 20 may contribute more length to device 10 than resistance strap 30. However, the length of resistance strap 30 may vary. It is also understood that one end of resistance strap 30 (e.g., left end 32) may be pulled further downward than the other end of resistance strap 30 (e.g., right end 34), and vice versa.

In the illustrated embodiment of FIG. 1, resistance strap 30 is removably coupled to support strap 20 via hook 36, illustratively another carabiner, and an intermediate strap 38. In one embodiment, intermediate strap 38 is constructed of a flexible, inelastic material, like the nylon webbing of support strap 20. In another embodiment, intermediate strap 38 is constructed of a rigid material, such as plastic or metal. Intermediate strap 38 may be integrally coupled, mechanically coupled, or otherwise coupled to hook 36. In use, hook 36 hooks securely into loop 28 of support strap 20, as shown in FIG. 1, and resistance strap 30 extends through intermediate strap 38, as shown in FIGS. 5A and 5B.

According to an exemplary embodiment of the present disclosure, user 100 may quickly and easily couple hook 36 into a desired loop 28 of support strap 20 to adjust the height of resistance strap 30 above the ground. Resistance strap 30 may be raised relative to support strap 20 and the ground by inserting hook 36 into a desired loop 28 located near top end 11 of device 10, and resistance strap 30 may be lowered relative to support strap 20 and the ground by inserting hook 36 into a desired loop 28 located near bottom end 12 of device 10. In one example, a tall user 100 may raise resistance strap 30 relative to support strap 20 and the ground, while a short user 100 may lower resistance strap 30 relative to support strap 20 and the ground. As another example, user 100 may raise resistance strap 30 relative to support strap 20 and the ground to increase resistance for one exercise (e.g., a standing exercise) and may lower resistance strap 30 relative to support strap 20 and the ground to decrease resistance for another exercise (e.g., a seated exercise).

Optionally, device 10 may further include one or more extension straps 50 to alter the length of device 10. In FIG. 2, extension strap 50 is located above support strap 20, but it is also within the scope of the present disclosure to locate extension strap 50 beneath support strap 20 (e.g., between support strap 20 and resistance strap 30). Without extension strap 50 in place, as shown in FIG. 1, device 10 is relatively short in overall length. On the other hand, with extension strap 50 in place, as shown in FIG. 2, device 10 is relatively long in overall length. In one example, a short user 100 may use extension strap 50 to lengthen device 10, while a tall user 100 may remove extension strap 50 to shorten device 10. As another example, user 100 may use extension strap 50 to reach a high ceiling beam B, but may avoid using extension strap 50 to reach a standard-height ceiling C. An exemplary extension strap 50 is capable of lengthening device 10 by about 10 inches to about 20 inches, and more specifically by about 15 to about 18 inches, for example. However, the size of extension strap 50 may vary depending on the height of the horizontal support (e.g., beam B, ceiling C) above user 100. Also, it is within the scope of the present disclosure to provide device 10 with a plurality of extension straps 50 of different sizes.

With resistance strap 30 at rest, ends 32, 34, of resistance strap 30 may come to rest near the head or shoulders of user 100, as shown in FIG. 1. For an adult user 100 that is about 5.5 feet tall, for example, device 10 may be adjusted to position ends 32, 34, of resistance strap 30 about 4.5 feet, 5 feet, or 5.5 feet from the ground. As discussed above, adjusting device 10 may involve selecting a different loop 28 of support strap 20 and/or using or excluding an extension strap 50, for example.

According to another exemplary embodiment of the present disclosure, a plurality of resistance straps 30 are provided, each resistance strap 30 having a different level of resistance. The level of resistance may be altered by varying the thickness of each resistance strap 30. The plurality of resistance straps 30 may include, for example, a thin-walled tube that supports less than 10 lbs. of maximum resistance, a medium-walled tube that supports more than 10 lbs. of maximum resistance, and a thick-walled tube that supports more than 20 lbs. of maximum resistance. In this manner, user 100 may select a resistance strap 30 having a desired level of resistance.

Device 10 further includes handles coupled to resistance strap 30. Specifically, device 10 includes a left handle 42 coupled to left end 32 of resistance strap 30 and a right handle 44 coupled to right end 34 of resistance strap 30, as shown in FIGS. 5A and 5B, where "left" and "right" are described and illustrated herein from the perspective of user 100. In the illustrated embodiment of FIG. 5C, each handle 42, 44, defines an aperture 46, which is optionally surrounded by a metal grommet 48, for receiving the corresponding end 32, 34, of resistance strap 30. Also, each end 32, 34, of resistance strap 30 may be enlarged or knotted, as shown in FIG. 5B, to prevent resistance strap 30 from slipping through each aperture 46.

Each handle 42, 44, includes a hand grip portion 60 and a foot grip portion 62. In the illustrated embodiment of FIGS. 5A-5C, hand grip portion 60 is defined by a first, inner loop 64 of material having a handle bar 66. Inner loop 64 may be constructed of a flexible, inelastic material, like the nylon webbing of support strap 20. Handle bar 66 may wrap around the material of inner loop 64 and may be constructed of plastic, metal, or another suitable material. It is also within the scope of the present disclosure that handle bar 66 may be padded for comfort and improved grip. Handle bar 66 should be sized to fit within the gripped hand of user 100. An exemplary handle bar 66 may be about 3 inches to about 6 inches in width WH, and more specifically about 4.5 inches to about 5 inches in width WH, such as about 4.75 inches in WH. To accommodate handle bar 66, the perimeter of inner loop 64 may span about 12 inches to about 18 inches, and more specifically about 14 inches.

In the same illustrated embodiment of FIGS. 5A-5C, foot grip portion 62 is defined by a second, outer loop 68 of material that surrounds inner loop 64 and is distinct from inner loop 64. Outer loop 68 and inner loop 64 may be constructed of the same flexible, inelastic material, such as nylon webbing, and may be joined together using grommet 48 or another suitable fastener, as shown in FIG. 5C. Outer loop 68 should be sized to receive the foot of user 100. Thus, the perimeter of outer loop 68 may span about 20 inches to about 25 inches, and more specifically about 22 inches. Because inner loop 64 is distinct from outer loop 68, handle bar 66 on inner loop 64 (which is normally centered within outer loop 68) may shift upward and/or sideways to accommodate the foot of user 100 within outer loop 68. Unlike hand grip portion 60, foot grip portion 62 need not include a handle bar. Instead, the foot or shoe of user 100 may be placed directly against the material of outer loop 68.

Figure 6:
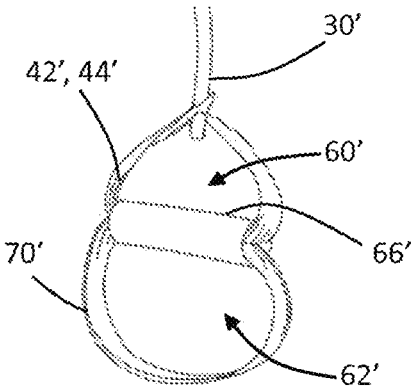
FIG. 6 is a front perspective view of another handle.

Another handle 42', 44', is shown in FIG. 6. Like handle 42, 44 (FIG. 5C), handle 42', 44' (FIG. 6) includes a hand grip portion 60' and a foot grip portion 62'. However, unlike handle 42, 44 (FIG. 5C), which includes distinct inner and outer loops 64, 68, handle 42', 44' (FIG. 6) includes a continuous loop 70' arranged in a "figure-8" shape. Handle bar 66' is centrally located on loop 70' along the intersection between hand grip portion 60' and a foot grip portion 62'.

Figure 7:
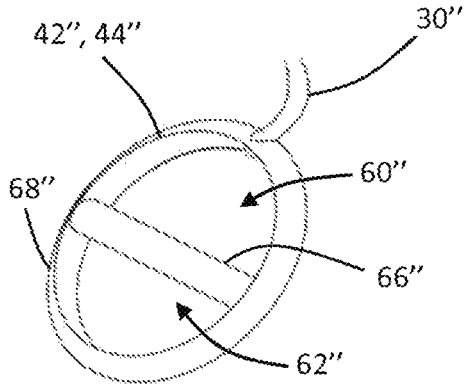
FIG. 7 is a front perspective view of yet another handle.

Yet another handle 42", 44", is shown in FIG. 7. Like handle 42, 44 (FIG. 5C), handle 42", 44" (FIG. 7) includes a hand grip portion 60" and a foot grip portion 62". However, unlike handle 42, 44 (FIG. 5C), which includes distinct inner and outer loops 64, 68, handle 42", 44" (FIG. 7) includes a single, outer loop 68". Handle bar 66" spans the entirety of outer loop 68" and is fixedly coupled to outer loop 68".

Figure 8A:
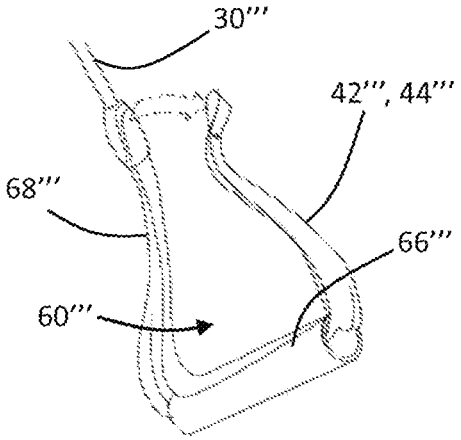
FIG. 8A is a front perspective view of still yet another handle shown in an open configuration.
Figure 8B:
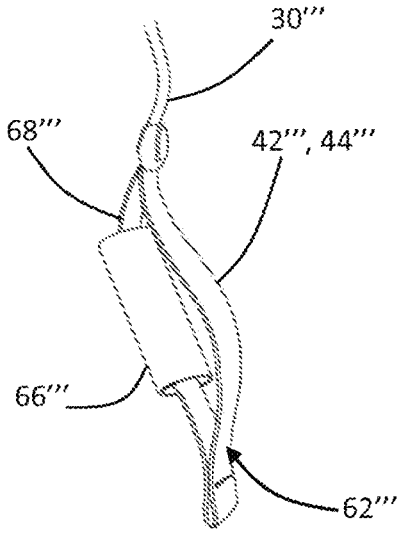
FIG. 8B is a front perspective view of the handle of FIG. 8A shown in a closed configuration.

Still yet another handle 42", 44", is shown in FIGS. 8A and 8B. Handle 42", 44", includes a single, outer loop 68", that may be snapped open (FIG. 8A) and closed (FIG. 8B). Handle bar 66' is slideably coupled to outer loop 68' to define either hand grip portion 60' (FIG. 8A) or foot grip portion 62' (FIG. 8B). With handle bar 66' positioned horizontally on outer loop 68' (FIG. 8A), handle bar 66' may receive a gripped hand. By contrast, with handle bar 66' positioned vertically on outer loop 68' (FIG. 8B), the now-exposed region of outer loop 68' may receive a foot.

In operation, when resistance strap 30 is stretched by pulling downward on handles 42, 44, resistance strap 30 resists or opposes the pulling movement. The resistance from resistance strap 30 provides a unique, fun, effective, efficient, and total-body workout. The resistance from resistance strap 30 also enhances the workout. Over the same amount of time, user 100 may burn as many calories using device 10 as if he or she had run a long distance at a fast, 6-minute-mile pace. Thus, device 10 may have a larger metabolic impact than long-distance running Device 10 has been shown to boost the metabolism of user 100 for 1 day, 2 days, or more. Therefore, even if user 100 only works out with device 10 during 3 days or 4 days of a week, user 100 may maximize his or her metabolism over the entire week, for example.

Figure 9A:
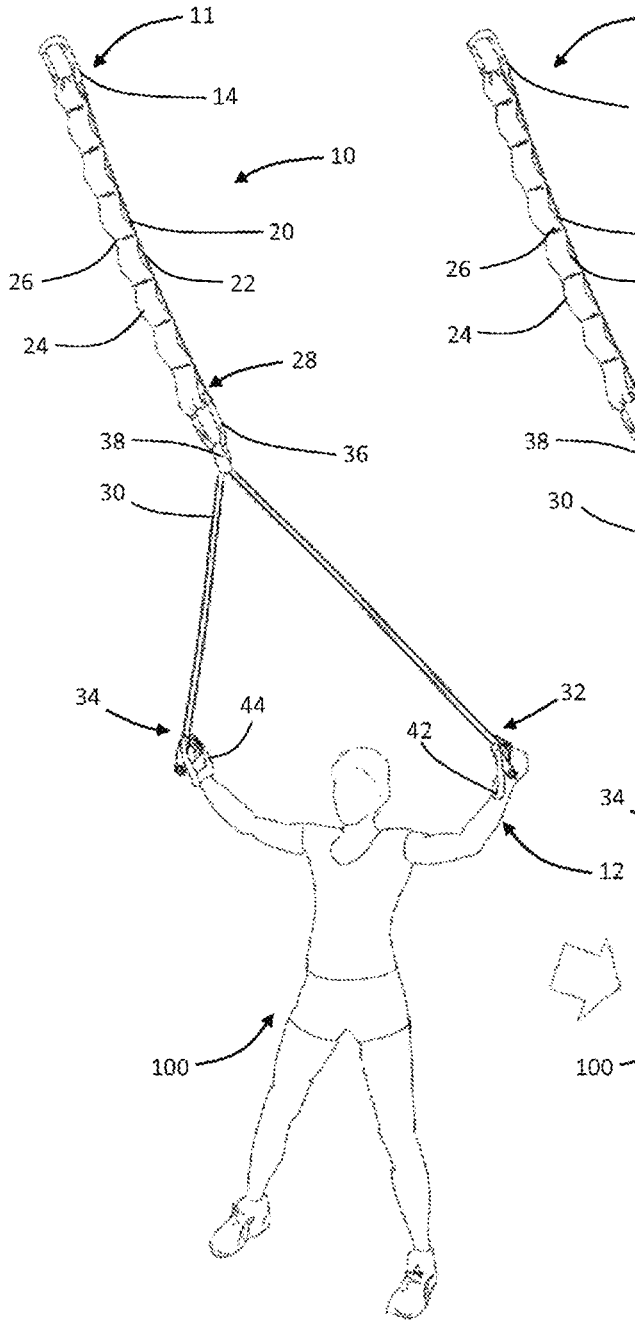
FIG. 9A is a front perspective view of the device of FIG. 1 in use, the user standing with his or her arms raised.
Figure 9B:
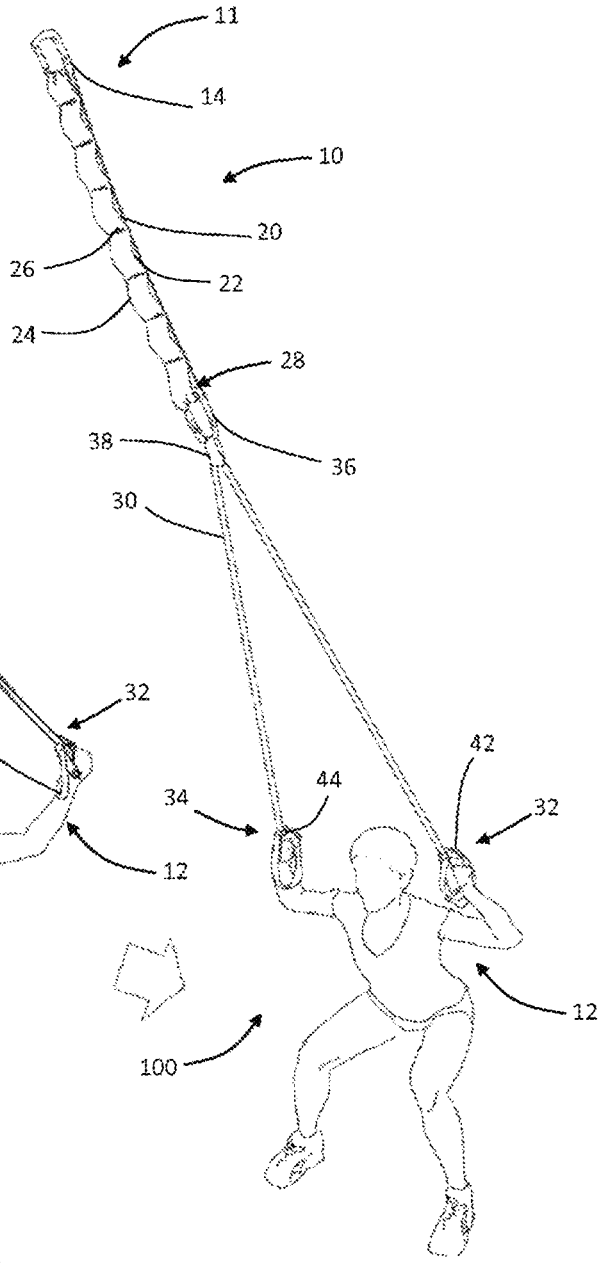
FIG. 9B is a front perspective view similar to FIG. 9A, the user squatting with his or her arms bent.

In FIGS. 9A and 9B, for example, user 100 bends his or her elbows and pulls downward on handles 42, 44, to stretch resistance strap 30, which works the muscles of the upper body (e.g., arms, shoulders). Additionally, user 100 bends his or her knees and squats downward to simultaneously work the muscles of the lower body (e.g., abdominal core, quad region). Compared to standard squats, device 10 enables user 100 to work more muscles in a shorter period of time.

Figure 10A:
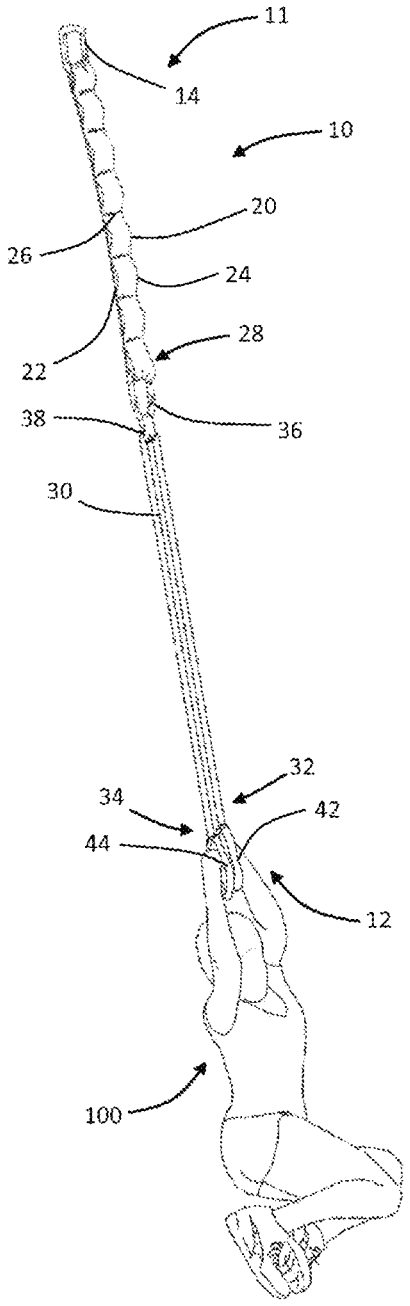
FIG. 10A is a front perspective view of the device of FIG. 1 in use, the user sitting with his or her arms raised.
Figure 10B:
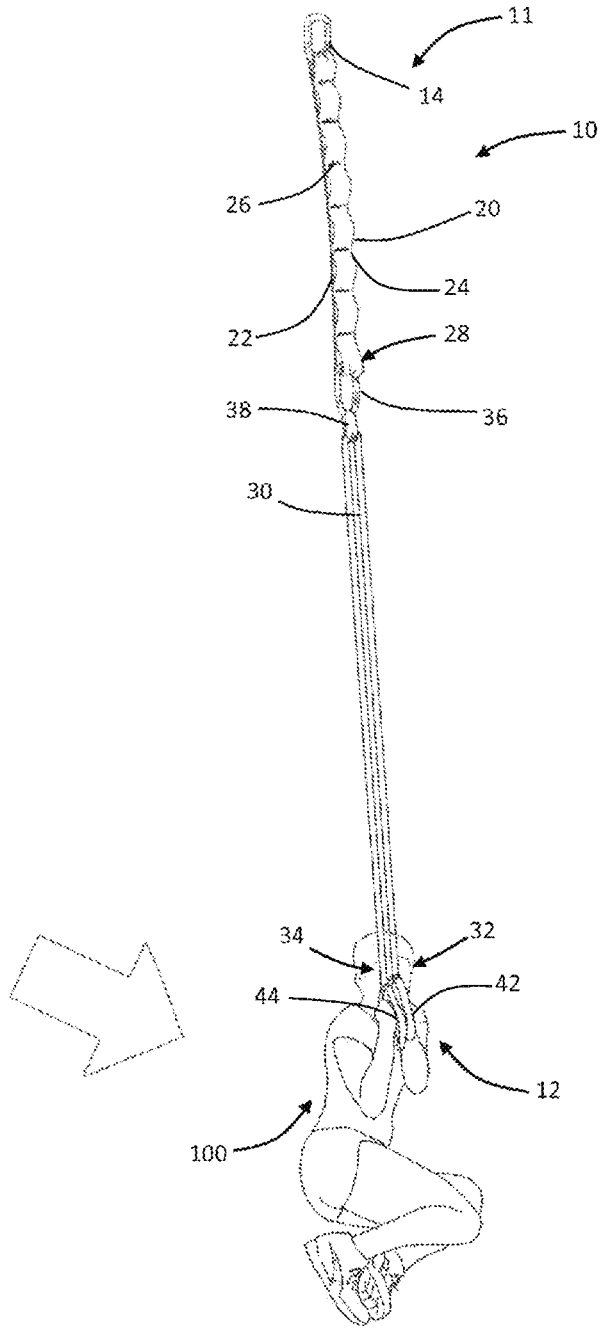
FIG. 10B is a front perspective view similar to FIG. 10A, the user crunching downward with his or her arms bent.

In FIGS. 10A and 10B, as another example, user 100 bends his or her elbows and pulls downward on handles 42, 44, from a seated position to stretch resistance strap 30 even further, which works the muscles of the upper body (e.g., arms, shoulders). Additionally, user 100 tightens his or her abdominal core muscles to simultaneously work the lower body. Compared to standard crunches, device 10 enables user 100 to work more muscles in a shorter period of time. Although standard crunches may work a limited region of the abdominal muscles, for example, device 10 may work the abdominal muscles, oblique muscles, pectoral muscles, and muscles near the ribs, hips, and lower back.

User 100 may perform a wide variety of exercises with device 10. For example, user 100 may perform anaerobic exercises with device 10 (e.g. leg lifts, squats, arm pulls) to gain strength, to build new lean tissue, and to improve flexibility. User 100 may also perform aerobic exercises with device 10 (e.g., jumping jacks, kicks, running in place) to improve cardiovascular health, to improve endurance, and to burn calories and fat. It is understood that these anaerobic and aerobic benefits may be realized by the same exercise motion. For example, an anaerobic, strength-building motion with device 10 may cause a muscle to break down, and then the body may aerobically burn calories and fat to repair the muscle.

Also, user 100 may grip device 10 in a variety of ways. For example, user 100 may hold the hand grip portions 60 of handles 42, 44, or user 100 may rest his or her feet against the foot grip portions 62 of handles 42, 44. Also, user 100 may hold handles 42, 44, apart in different hands (FIGS. 9A and 9B) or together in the same hand for double the resistance (FIGS. 10A and 10B).

Additionally, user 100 may position his or her body in a variety of ways when using device 10. For example, user 100 may manipulate device 10 from a standing position (FIG. 9A), a squatting position (FIG. 9B), a seated position (FIGS. 10A and 10B), while lying down (e.g., a plank position, a cycling position), or from another position. Providing user 100 with full freedom of movement beneath device 10, as shown, facilitates these different positions. For example, user 100 may be positioned behind device 10 (FIGS. 9A and 9B), in front of device 10, to the side of device 10 (FIG. 10A), or directly beneath device 10 (FIG. 10B) without interference from a vertical door jamb, a door, or another obstruction.

Also, user 100 may use device 10 in combination with other exercise equipment, such as gliders, body bars, weights, treadmills, and other equipment. For example, user 100 may lift arm weights while performing leg lifts with his or her foot in device 10.

Furthermore, user 100 may operate device 10 in a variety of settings. For example, user 100 may operate device 10 in a group class setting with a live instructor, optionally a certified instructor, and other class members. In this class setting, a plurality of devices 10 may be spaced apart and hung from the ceiling of a fitness center for simultaneous use by the instructor and the class members. As another example, user 100 may operate device 10 individually, such as at home. In this at-home setting, user 100 may follow along with a web-based instruction session or a recorded instruction video, for example.

Device 10 may accommodate a wide range of users 100. For example, as discussed above, the total length of device 10, the elevation of device 10 above the ground, and the resistance of device 10 may be customized to accommodate the abilities, limitations, and goals of each particular user 100.

Device 10 may be sold in a kit. The kit may include support strap 20, a plurality of resistance straps 30, optionally with pre-attached handles 42, 44, and a plurality of extension straps 50. The kit may also include written instructions for safely and properly assembling and using device 10. The kit may further include a recorded instruction video for at-home use, as discussed above.

The disclosed embodiments provide a combination of cardiovascular training and resistance training. The disclosed embodiments provide an inclusive workout method that allows the user to obtain the benefits of both forms of training in one single workout. Combining cardio and resistance training, the disclosed embodiments offer self-directed resistance that is simply adjusted by adjusting a user's distance from an anchor point. The disclosed embodiments provide both positive and negative resistance working both the agonist and antagonist muscle groups.

In one embodiment, a method of combined cardiovascular training and resistance training allows an instructor to construct a seamless class that works both intrinsic and extrinsic muscle groups, while challenging the core and cardio endurance. When the external resistance of the physical training device 10 is combined with functional resistance training and small bursts of cardio, the effectiveness of the user's time and effort is improved and maximized.

In one embodiment, the method includes a warm up to aid the user in preparing physiologically and psychologically for exercise, thereby reducing the chance of joint and muscle injury. The warm up prepares the body for exercising by increasing blood flow to the muscles, thereby allowing them to loosen up, which can raise the flow of oxygen to the muscle cells. Doing this gradually increases the body's temperature. This then increases the speed and force of muscular contractions.

The method also includes focus exercises that include functional training exercises focusing on one or more muscle groups, utilizing the resistance of the physical training device 10. The method also integrates blast exercises that include cardio training exercises utilizing the previously trained muscle groups and focusing on increasing heart rate.

In one embodiment, a method for use with a physical training device is provided. The device includes an inelastic support strap and an elastic resistance strap having first and second handles. The method includes coupling the elastic resistance strap to one of a plurality of loops in the inelastic support strap. The inelastic support strap has an end coupled to a support. The method also includes pulling the first and second handles of the elastic resistance strap to alternate between resistance training and cardiovascular interval training.

In one embodiment, a method for use with a physical training device is provided. The device including an elastic resistance strap having first and second handles. The method includes pulling at least one of the first and second handles to generate force on a target muscle group through resistance training. The method also includes pulling the at least one of the first and second handles to generate anaerobic and aerobic muscle activity within the target muscle group through cardiovascular interval training.

Figure 11:
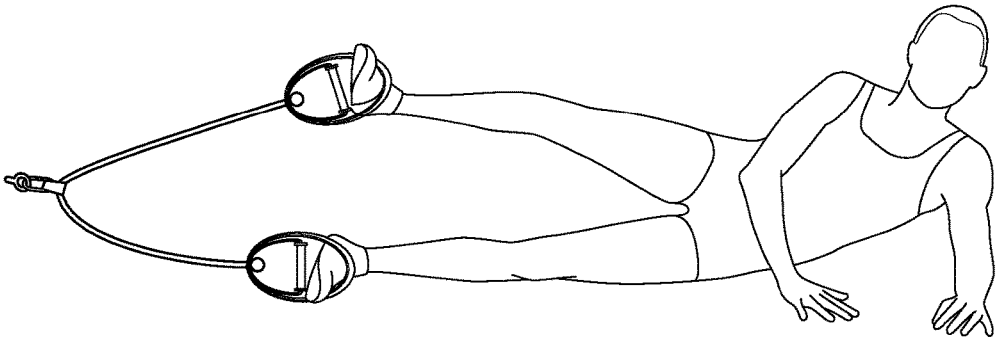
FIG. 11 illustrates an exercise formed in accordance with an embodiment.

In one method of the disclosed embodiments as illustrated in FIG. 11, the user lies on their side with the loops of the device 10 around the top of each foot. The user supports their upper body with the opposite forearm resting on the floor and their hand on the floor in front of their chest to maintain balance. The user pulls a foot against the loop to create resistance. The user pulls their foot up through the rib cage and flexes the foot. The user then slowly raises their leg, while keeping their core engaged. The leg on the floor is kept stationary.

Figure 12:
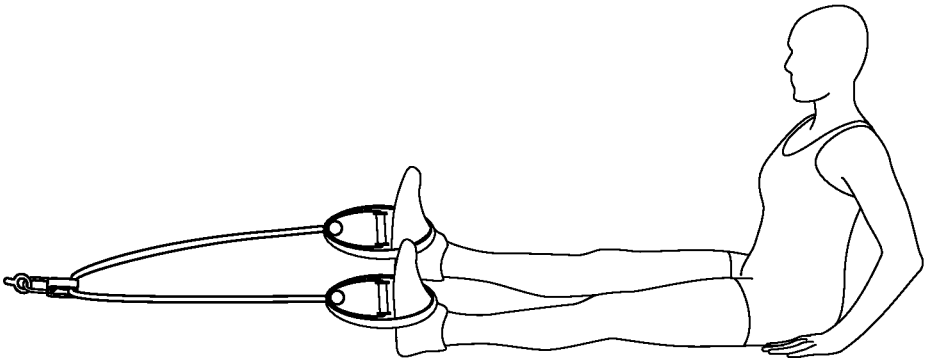
FIG. 12 illustrates an exercise formed in accordance with an embodiment.

In one method of the disclosed embodiments as illustrated in FIG. 12, the user is positioned in the seated position with their feet through the loops of the device 10 and their core engaged. The body is supported with hands pressed into the floor on each side of the body while sitting upright. Keeping the feet flexed, the user raises one foot, lifting the leg and thigh off the ground, while the other leg remains stationary on the ground. Once completed, the exercise is repeated with the opposite leg. In one embodiment, the leg may be held off the ground for a predetermined time.

Figure 13:
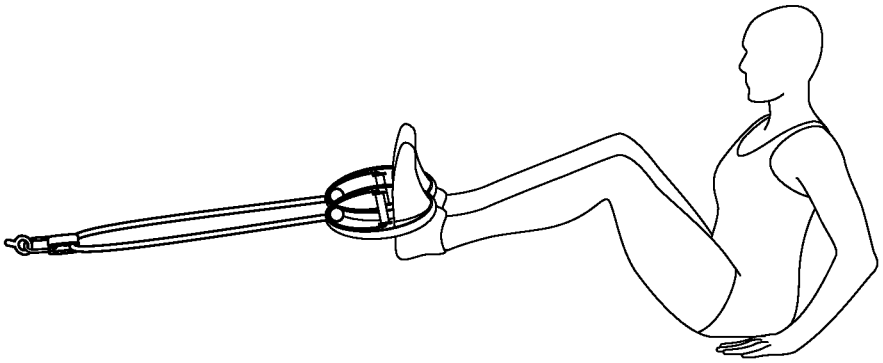
FIG. 13 illustrates an exercise formed in accordance with an embodiment.

In one method of the disclosed embodiments as illustrated in FIG. 13, the user sits in the seated position with both feet positioned between the loops of the device 10. For balance, the user rests their fingertips on the floor on each side of the body. The user maintains a 90° angle in the arms, while leaning back slightly. The user then flexes the feet and pulls the knees toward the chest, while keeping the legs together.

Figure 14:
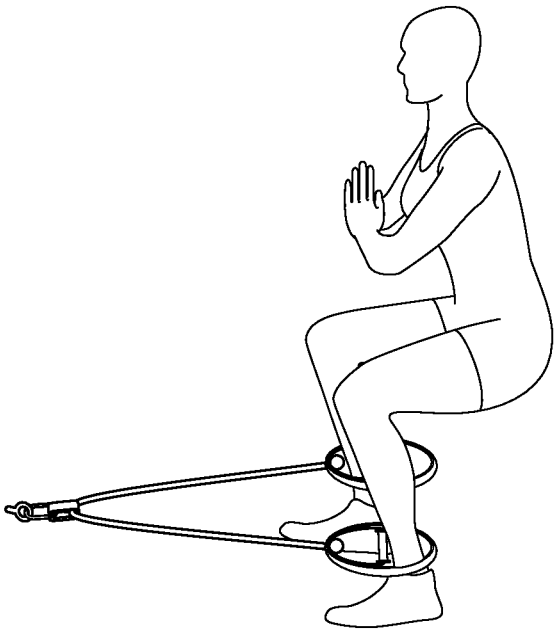
FIG. 14 illustrates an exercise formed in accordance with an embodiment.

In one method of the disclosed embodiments as illustrated in FIG. 14, the user places each foot through the respective loop of the device 10. Standing with feet slightly wider than shoulder width apart and toes turned outward, the user presses the palms together and lifts the lower body into a wide squat.

Figure 15:
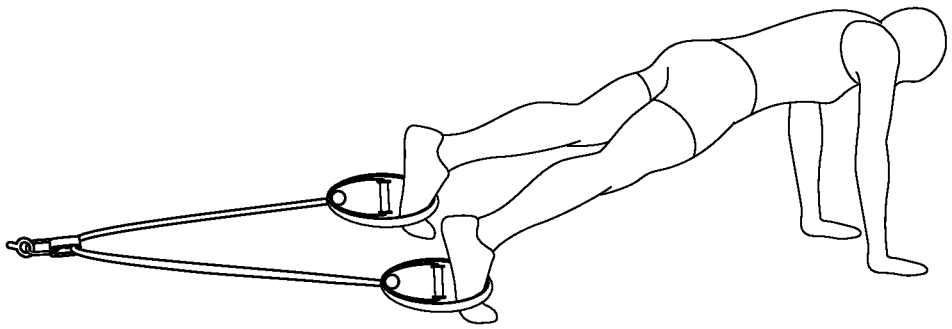
FIG. 15 illustrates an exercise formed in accordance with an embodiment.

In one method of the disclosed embodiments as illustrated in FIG. 15, the user places her feet through the loops of the device 10 and moves into plank position with her feet shoulder width apart. Keeping one foot pressed to the floor, the user flexes the opposite foot and brings her knee toward her elbow. The user then returns to plank position and repeats the exercise with the other foot.

Figure 16:
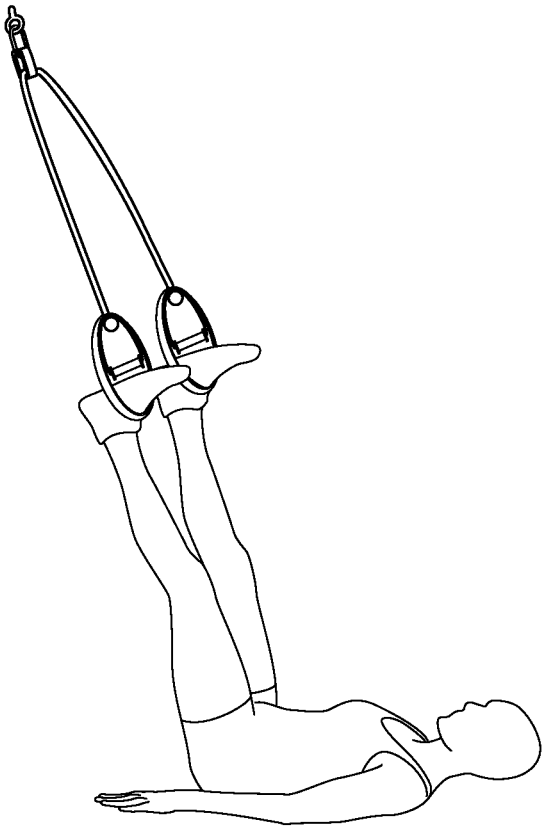
FIG. 16 illustrates an exercise formed in accordance with an embodiment.

In one method of the disclosed embodiments as illustrated in FIG. 16, the user lies on her back, places her heels in the loops of the device 10, and flexes her feet. The user's arms are kept flat on the floor, parallel to the body. The user lifts her legs, keeping the feet flexed. The user's legs are slowly opened and then closed.

Figure 17:
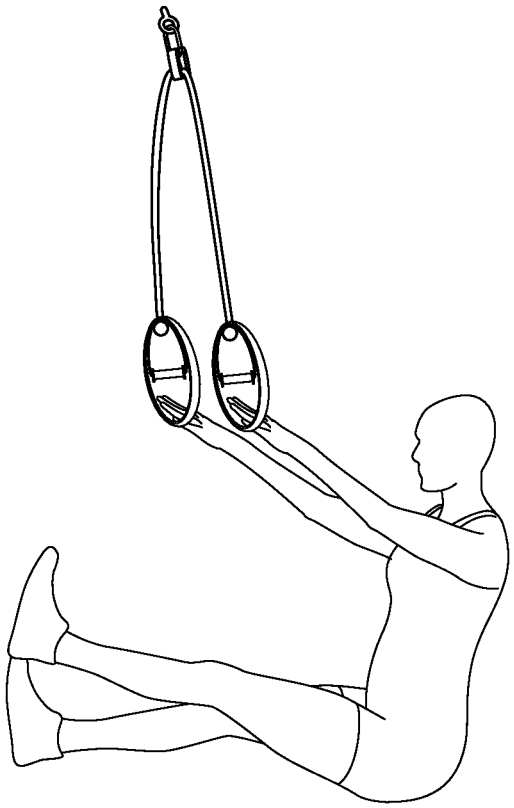
FIG. 17 illustrates an exercise formed in accordance with an embodiment.

In one method of the disclosed embodiments as illustrated in FIG. 17, in a seated C-curve position, the user places her hands in the handles of the device 10. While sitting upright, the user flexes both feet and lifts one leg and thigh off the ground. The user squeezes the leg to the closed position and repeats.

Figure 18:
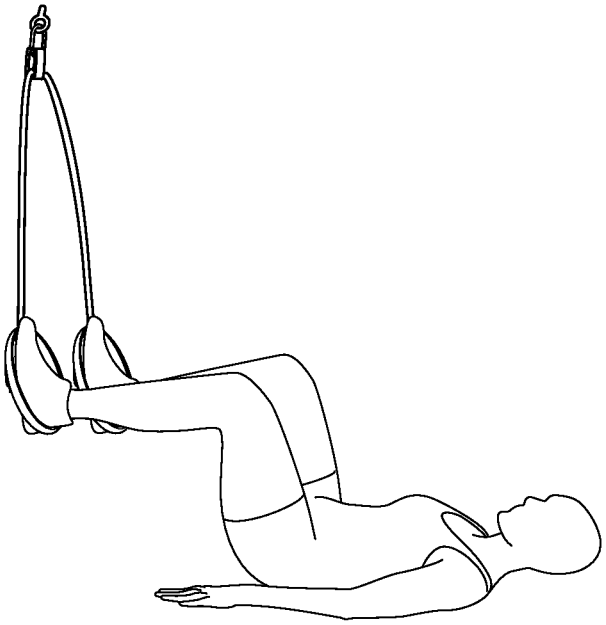
FIG. 18 illustrates an exercise formed in accordance with an embodiment.

In one method of the disclosed embodiments as illustrated in FIG. 18, the user lies on her back and places her heels in the loop of the device 10, while flexing her feet. The user's arms are kept flat on the floor, parallel to the body. The user bends her knees into a 90° angle and then pushes her heels toward her buttocks. The user then returns her legs back to a 90° angle while keeping her feet flexed. The user then bends and presses through the heels.

Figure 19:
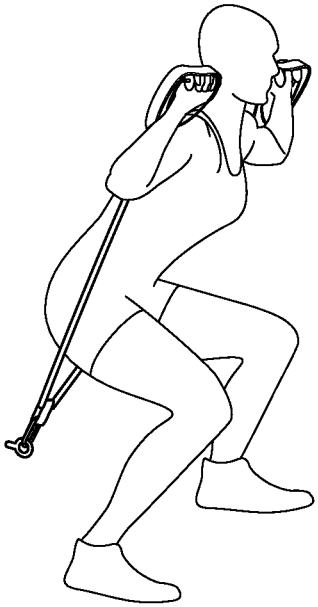
FIG. 19 illustrates an exercise formed in accordance with an embodiment.

In one method of the disclosed embodiments as illustrated in FIG. 19, the user grasps each handle with her body facing away from the anchor point of the device 10. The user keeps her hands next to her ears, making a 90° angle with the elbow. The user stands with her feet slightly wider than shoulder width apart and turns her toes slightly outward. The user lowers her body into a wide squat.

Figure 20:
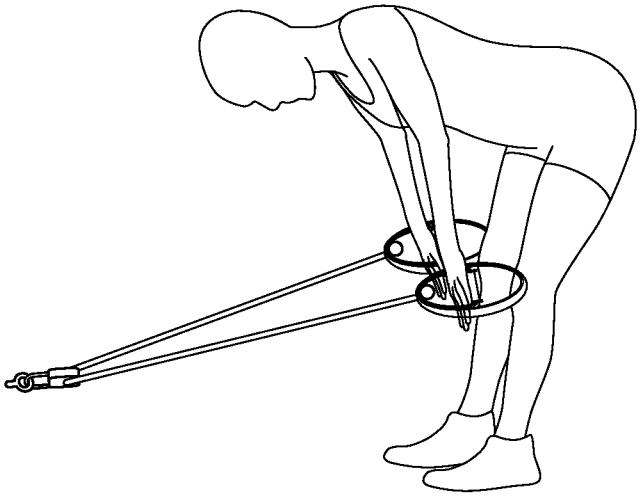
FIG. 20 illustrates an exercise formed in accordance with an embodiment.

In one method of the disclosed embodiments as illustrated in FIG. 20, the user pronates her hands and grasps each handle. Keeping the legs straight, the user bends at the waist so that her back is flat. The user straightens her arms and squeezes the handles backward toward the sides of her calves. The arms are then released to the neutral position and the exercise is repeated.

Figure 21:
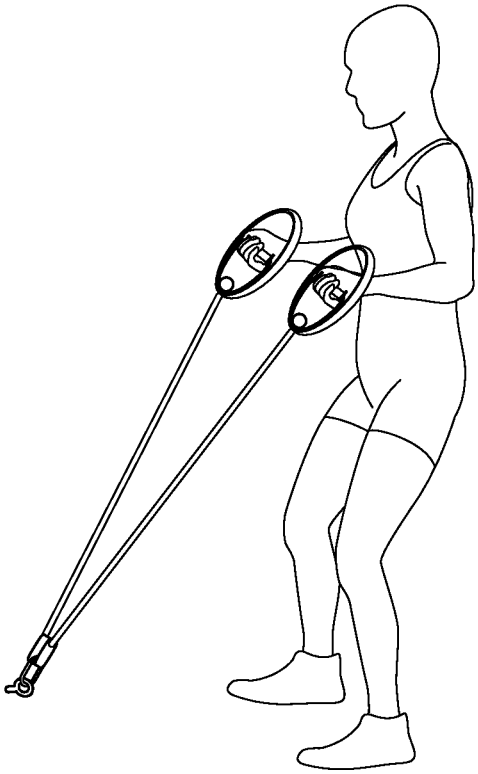
FIG. 21 illustrates an exercise formed in accordance with an embodiment.

In one method of the disclosed embodiments as illustrated in FIG. 21, the user supinates her hands and grasps each handle, while standing shoulder width apart with her legs slightly bent. The user squeezes the handles toward her chest with her elbows close to her waist. The user then releases her arms to neutral and repeats the exercise.

Figure 22:
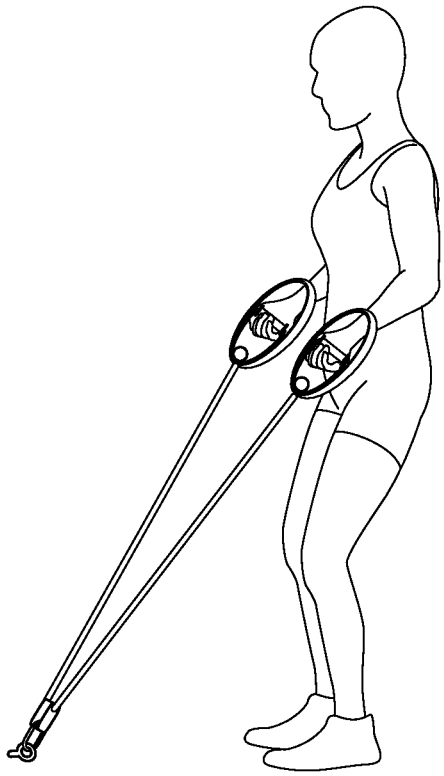
FIG. 22 illustrates an exercise formed in accordance with an embodiment.

In one method of the disclosed embodiments as illustrated in FIG. 22, the user grasps each handle while standing upright with her feet together and slight bend in her knees. The user bends her arms to make a 90° at the elbow. The user then squeezes the handles backwards, while keeping her arms close to her body and pinching her shoulder blades toward one another. The user then releases her arms to neutral and repeats the exercise.

Figure 23:
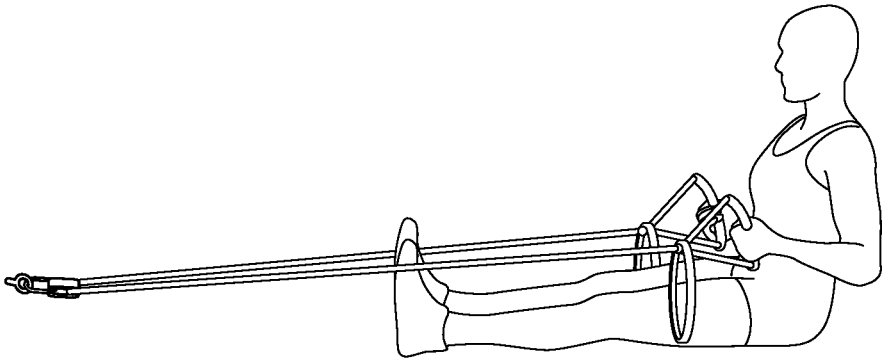
FIG. 23 illustrates an exercise formed in accordance with an embodiment.

In one method of the disclosed embodiments as illustrated in FIG. 23, the user assumes an upright, seated position with her legs together and her feet flexed. The user grasps each handle and bends her arms to a 90° angle at the elbow. The user then squeezes the handles backward, while keeping her arms close to the body. The user then releases her arms to neutral and repeats the exercise.

Figure 24:
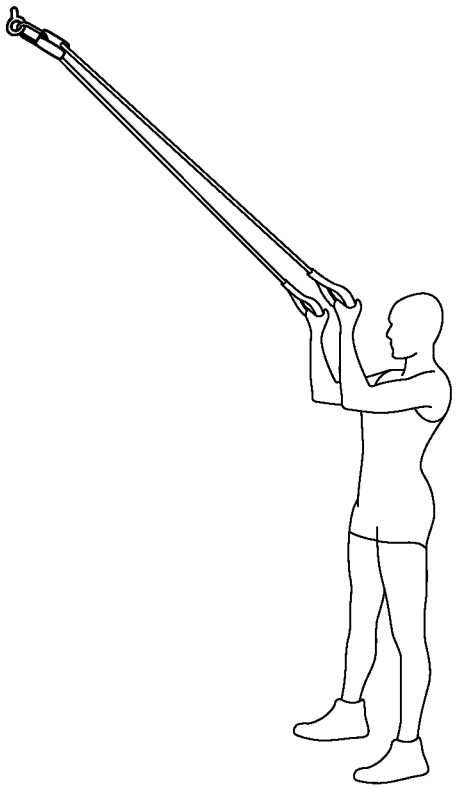
FIG. 24 illustrates an exercise formed in accordance with an embodiment.

In one method of the disclosed embodiments as illustrated in FIG. 24, the user grasps each handle and stands upright with her feet shoulder width apart and a slight bend in her knees. The user bends her arms to a 90° angle at the elbow with the elbow at shoulder height. The user then flexes and extends her arms repeatedly.

Figure 25:
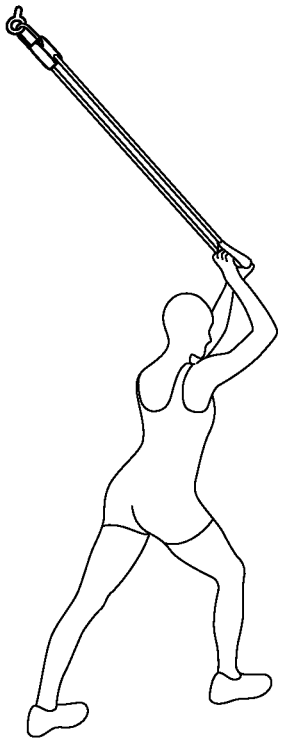
FIG. 25 illustrates an exercise formed in accordance with an embodiment.

In one method of the disclosed embodiments as illustrated in FIG. 25, the user pronates each hand and grasps the handles. The user then stands in a high lunge. The user holds the handles close together and bends her elbows. The user then repeatedly presses her hands into the handles and then relaxes.

Figure 26:
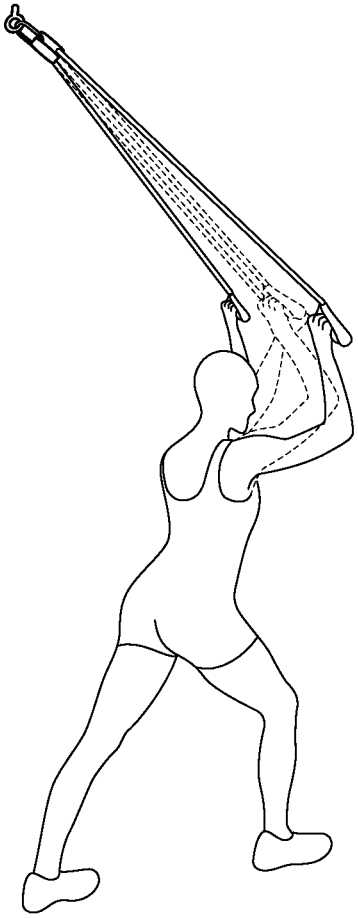
FIG. 26 illustrates an exercise formed in accordance with an embodiment.

In one method of the disclosed embodiments as illustrated in FIG. 26, the user pronates each hand and grasps the handles. The user then stands in a high lunge. The user holds the handles close together and bends her elbows. The user then repeatedly presses her hands into the handles in double time motion and then relaxes until the muscle group is exhausted. During this exercise the user's neck and shoulders should remain relaxed.

Figure 27:
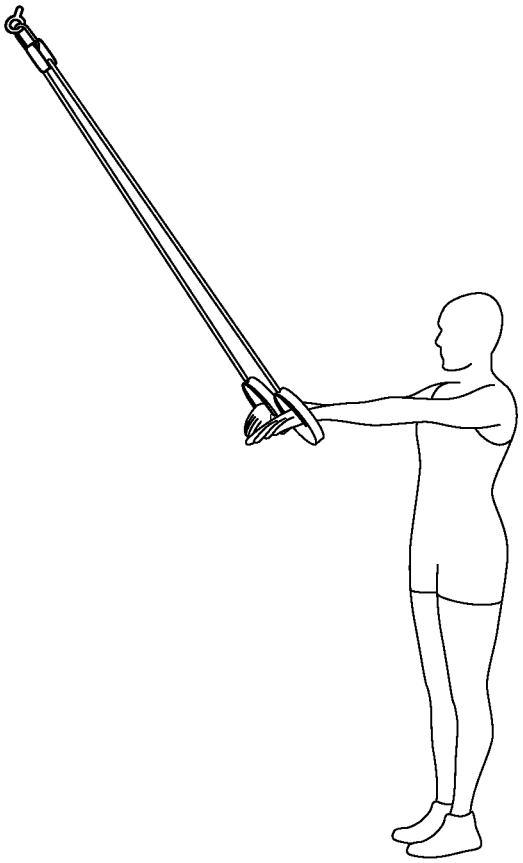
FIG. 27 illustrates an exercise formed in accordance with an embodiment.

In one method of the disclosed embodiments as illustrated in FIG. 27, the user pronates her hands and with flat palms places a hand on each handle. The user stands with her feet together while keeping her arms straight and pressing into the handles. Starting at shoulder level, the user repeatedly presses down toward her quadriceps and returns to standing position until the muscle group is exhausted.

Figure 28:
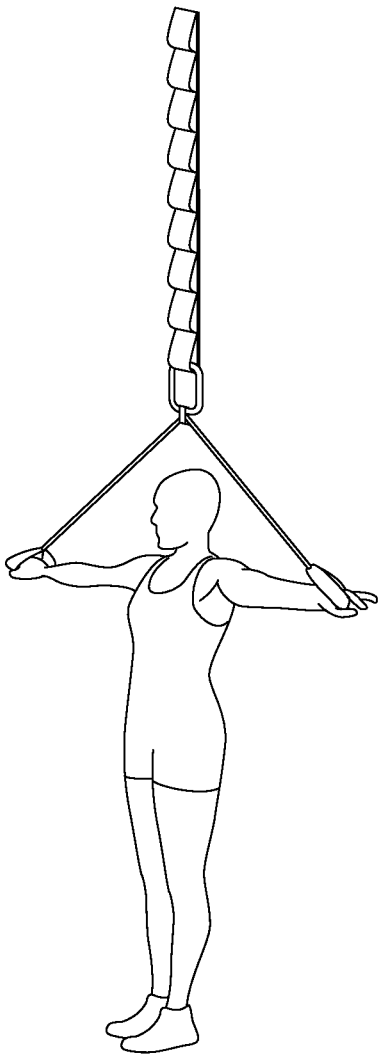
FIG. 28 illustrates an exercise formed in accordance with an embodiment.

In one method of the disclosed embodiments as illustrated in FIG. 28, the user pronates each hand and grasps the handles. The user stands with her feet together while keeping her arms straight out to each side. Starting at shoulder level, the user repeatedly presses each handle down toward her hips and then returns her hands to shoulder height until the muscle group is exhausted.

Figure 29:
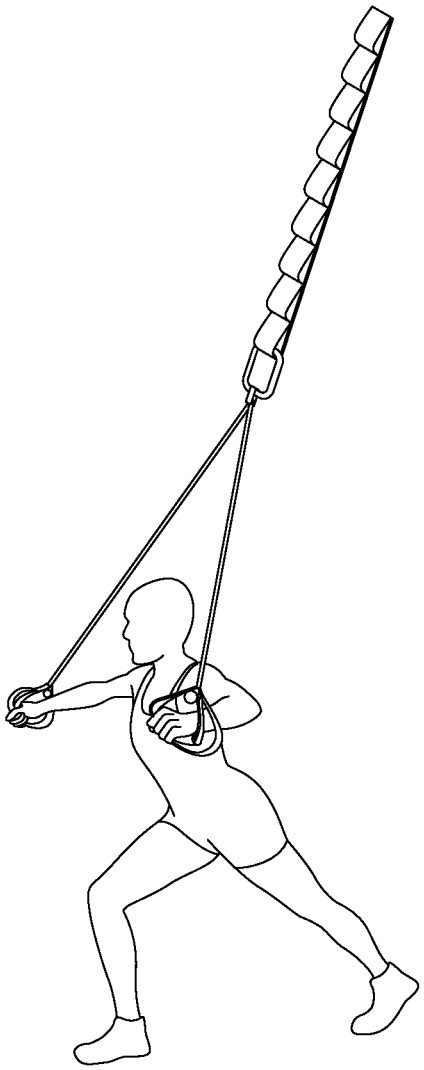
FIG. 29 illustrates an exercise formed in accordance with an embodiment.

In one method of the disclosed embodiments as illustrated in FIG. 29, the user grasps the handles while bending her arms to a 90° angle at the elbow. The user stands in a high lunge and presses down as though she is squeezing a ball with her arms. This motion is repeated until the muscle group is exhausted.

Figure 30:
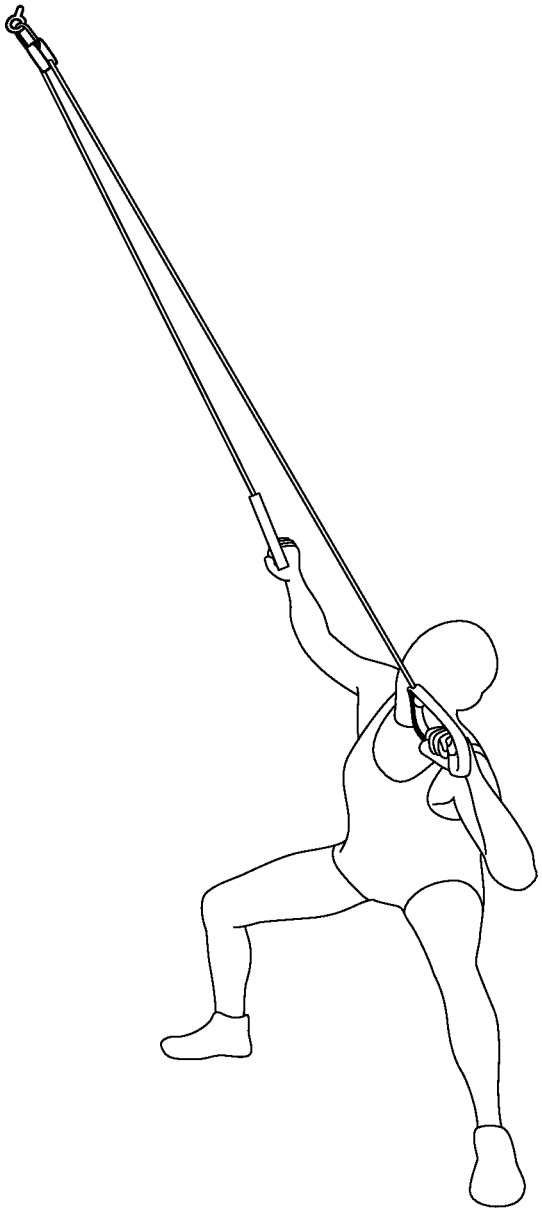
FIG. 30 illustrates an exercise formed in accordance with an embodiment.

In one method of the disclosed embodiments as illustrated in FIG. 30, the user pronates her hands and grasps the handles. The user stands with her feet shoulder width apart while lifting her knee to her elbow, thereby crunching her obliques. The user alternates knees.

Further, in describing representative embodiments, the disclosure may have presented a method and/or process as a particular sequence of steps. However, to the extent that the method or process does not rely on the particular order of steps set forth herein, the method or process should not be limited to the particular sequence of steps described. Other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

What is claimed is:

1. A method for use with a physical training device, the method comprising:

providing the physical training device including a distal end located near an overhead support, and a proximal end located near a user, an inelastic support strap located at the distal end of the device, the inelastic support strap extending toward the user from the overhead support, an intermediate strap extending toward the user from the inelastic support strap, wherein the inelastic support strap defines a plurality of loops, each loop being sized to receive a hook that is coupled to the intermediate strap to attach the intermediate strap to the inelastic support strap, an elastic resistance strap located near the proximal end of the device, the elastic resistance strap extending toward the user from the intermediate strap, the elastic resistance strap having a first end with a first handle, a second end with a second handle, and a middle portion between the first end and the second end;

coupling the elastic resistance strap to the overhead support so that at least one of the first end and the second end of the elastic resistance strap hangs freely from the overhead support; and pulling the at least one of the first handle and the second handle of the elastic resistance strap.

2. A method for use with a physical training device, the method comprising:

providing the physical training device including a distal end located near a support, and a proximal end located near a user, an inelastic support strap located at the distal end of the device, the inelastic support strap extending toward the user from the support, an intermediate strap extending toward the user from the inelastic support strap, wherein the inelastic support strap defines a plurality of loops, each loop being sized to receive a hook that is coupled to the intermediate strap to attach the intermediate strap to the inelastic support strap, an elastic resistance strap located near the proximal end of the device, the elastic resistance strap extending toward the user from the intermediate strap, the elastic resistance strap having a first end with a first handle, a second end with a second handle, and a middle portion between the first end and the second end;

coupling the elastic resistance strap to the support; and pulling at least one of the first handle and the second handle of the elastic resistance strap.

3. The method of claim 2, wherein the device has an obstruction-free radius of at least 20 inches from a longitudinal axis defined by the physical training device.

4. The method of claim 1, wherein the device has an obstruction-free radius of at least 20 inches from a longitudinal axis defined by the physical training device.

5. The method of claim 1 further comprising coupling the elastic resistance strap to one of a plurality of loops in the inelastic support strap.

6. The method of claim 1, further comprising positioning the first handle and the second handle of the elastic resistance strap at a height above the ground when the elastic resistance strap is at rest, wherein the height above the ground is selected from the group consisting of: 4.5 feet, 5 feet, and 5.5 feet.

7. The method of claim 1 further comprising coupling the elastic resistance strap to one of a plurality of loops in the inelastic support strap.

8. The method of claim 1, further comprising positioning the first handle and the second handle of the elastic resistance strap at a height above the ground when the elastic resistance strap is at rest, wherein the height above the ground is selected from the group consisting of: 4.5 feet, 5 feet, and 5.5 feet.

9. A method for use with a physical training device, the method comprising:

providing the physical training device including a distal end located near a support, and a proximal end located near a user, an inelastic support strap located at the distal end of the device, the inelastic support strap extending toward the user from the support, an intermediate strap extending toward the user from the inelastic support strap, wherein the inelastic support strap defines a plurality of loops, each loop being sized to receive a hook that is coupled to the intermediate strap to attach the intermediate strap to the inelastic support strap, an elastic resistance strap located near the proximal end of the device, the elastic resistance strap extending toward the user from the intermediate strap, the elastic resistance strap having a first end with a first handle, a second end with a second handle, and a middle portion between the first end and the second end;

pulling at least one of the first handle and the second handle to generate force on a target muscle group; and pulling the at least one of the first handle and the second handle to generate anaerobic and aerobic muscle activity within the target muscle group.

10. The method of claim 9 further comprising:

pulling the first handle with a first hand; and pulling the second handle with a second hand.

11. The method of claim 10 further comprising alternating pulling the first handle with the first hand, and pulling the second handle with the second hand.

12. The method of claim 9 further comprising using the physical training device secured to an overhead support.

13. The method of claim 9 further comprising using the physical training device secured to a wall support.

* * * * *